US006289687B1

(12) United States Patent
Kawano et al.

(10) Patent No.: US 6,289,687 B1
(45) Date of Patent: Sep. 18, 2001

(54) INTEGRAL TYPE AIR CONDITIONER

(75) Inventors: Yuki Kawano, Sakai; Yuji Shimamura, Nara, both of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/565,453

(22) Filed: May 5, 2000

(30) Foreign Application Priority Data

May 7, 1999 (JP) ..... 11-126780

(51) Int. Cl.[7] ..... F25D 23/12
(52) U.S. Cl. ..... 62/262; 62/263
(58) Field of Search ..... 62/262, 259.1, 62/263; 248/205.1; 312/242, 245, 246

(56) References Cited

U.S. PATENT DOCUMENTS 3,481,264 * 12/1969 Ulich .
3,861,283 * 1/1975 Shaner .

FOREIGN PATENT DOCUMENTS 8219541 8/1996 (JP) .
11063648 * 3/1999 (JP) .

* cited by examiner

*Primary Examiner*—William Doerrler
*Assistant Examiner*—Chen-Wen Jiang

(57) ABSTRACT

An integral type air conditioner is provided having its main unit fastened to an outer case by fastening device at a position manageable inside the room, instead of by fastening the main unit to the outer case with screws inserted from the outside of the outer case through the side faces thereof. Regardless of conditions of installation, the main unit can easily and surely be fastened and the main unit is never pushed out from the outside to the inside of the main unit. The integral type air conditioner has the outer case attached to an opening of a wall and the main unit is slid into the outer case and installed therein. The fastening device is provided for securely coupling the main unit and the outer case to each other at a position manageable inside the room so as to prevent the main unit from being pushed out into the room.

11 Claims, 6 Drawing Sheets

INTEGRAL TYPE AIR CONDITIONER

BACKGROUND OF THE INVENTION

1. Field of the Invention

The present invention relates to an integral type air conditioner constituted of an outer case, a main unit and a front panel, and particularly to improvements in the installation structure of such an integral type air conditioner.

2. Description of the Background Art

A conventional installation structure of an integral type air conditioner is described in conjunction with FIG. 14. The integral type air conditioner is formed of an outer case 1, a main unit 3 and a front panel 6. Outer case 1 is fit in an opening of a wall 2 and screwed thereto. Main unit 3 is then slid into outer case 1 and attached thereto with screws inserted from the outside of the outer case through the side faces of the case.

Specifically, outer case 1 is first set in the opening of wall 2 and then fixed to the sides and bottom of the opening by using fixing screws 21, and thereafter main unit 3 is slid into outer case 1. After this, screws 24 are inserted into holes 22 and 23 in both side faces of outer case 1 to firmly attach outer case 1 and main unit 3 to each other. Front panel 6 is finally fit on main unit 3 and outer case 1 and the installation work is thus completed.

Hole 22 is usually located in front of wall 2, i.e., inside the room and screw 24 is inserted therein to attach outer case 1 and main unit 3 to each other. If the air conditioner is mounted on a flat ground, hole 23 can additionally be used to similarly insert screw 24 therein so as to fix outer case 1 and main unit 3 to each other.

However, if the air conditioner is installed in a room on a high floor, the space for the installation work is separated by wall 2 so that hole 23 could be unavailable to receive screw 24 inserted therein after outer case 1 is fit in the opening of wall 2. Further, depending on the position where outer case 1 is fixed, hole 22 could be hidden in the opening of wall 2 and consequently screw 24 could not be inserted into hole 22. Moreover, if wall 2 is thick and main unit 3 needs to be inserted deep into the outer case in order to prevent an intake opening outside the room from being hidden by the wall, hole 22 could be hidden in the opening of wall 2. Even if the wall is thin, when front panel 6 and the wall surface are positioned on the same plane for presenting a good appearance, hole 22 could be hidden in the opening of wall 2. In these cases, it is impossible to insert screws 24 into both holes 22 and 23 and accordingly the installation is completed leaving outer case 1 and main unit 3 unfixed. Even if screwing is possible, the installation is sometimes completed without screwing.

When the conventional installation structure of the integral type air conditioner is employed, outer case 1 and main unit 3 could not be fastened to each other with screws inserted into both holes 22 and 23 or installation could be completed without screwing as described above. As a result, main unit 3 could be pushed out toward the inside of the room from the outside and the resultant opening could be utilized for breaking into the room unlawfully.

SUMMARY OF THE INVENTION

The present invention is devised to solve the problems above of the conventional structure. One object of the present invention is to provide an integral type air conditioner having a main unit which can be fixed at its front face inside the room to ensure that the main unit can be fastened in any installation condition, and which can easily be fixed without a special tool.

Considering the problems of the conventional structure in which the main unit and the outer case are fixed by screws inserted from the outside of the case into holes in the side faces thereof, the present invention is made to provide fastening means for fastening a main unit and an outer case to each other at a position which can be handled inside the room.

Specifically, an integral type air conditioner according to the present invention is installed by sliding a main unit into an outer case attached in an opening of a wall, the air conditioner having fastening means for securely coupling the slid-in main unit and the outer case to each other at a position which can be managed inside the room in order to prevent the main unit slid into the outer case from being pushed out into the room.

Various structures are employable as the fastening means for securely coupling the main unit and the outer case to each other at a position which can be handled inside the room. One exemplary means is a structure formed of a combination of a slit-shaped rectangular hole in the bottom of the outer case and a fixed angle having a hook-shaped bottom which is inserted into the rectangular hole and then slid therein to engage with the outer case and having an upright portion placed along the front face of the main unit.

The fixed angle is engaged with the outer case by its hook-shaped bottom portion and accordingly the main unit is prevented from separating from the outer case toward the front. Since the fixed angle is engaged with the outer case and the upright portion thereof fits along the front face of the main unit, even when the main unit is pushed from the outside toward the inside of the room, the upright portion functions as a stopper for preventing movement of the main unit.

The fixed angle is engaged with the outer case by inserting and then sliding its hook-shaped bottom in the rectangular hole in the bottom of the outer case. In order to prevent the fixed angle from inversely sliding to separate from the outer case or to prevent the fixed angle from becoming unstable and wobbling, preferably a substantially U-shaped elastic clip is used to hold therein the upright portion of the fixed angle and the front wall of the main unit, or preferably a wing bolt is used to fasten the upright portion of the fixed angle to the front wall of the main unit. In this way, it is possible to prevent the wobbling of the fixed angle as well as the reverse sliding thereof to separate from the rectangular hole of the outer case.

Another exemplary fastening means is a structure formed of a fixed plate attached to the bottom of the outer case and a movable plate rising along the front face of the main unit. The fixed plate has a blocking wall for preventing the raised and upright movable plate from inclining forward. The movable plate is slidable with respect to the fixed plate and allowed to incline forward when it is slid to separate from the blocking wall.

Specifically, the movable plate is coupled to the fixed plated attached to the bottom of the outer case such that the former can rise, incline and slide with respect to the latter, in order to prevent the main unit from moving. The blocking wall is provided to the fixed plate for preventing the movable plate rising along the front face of the main unit from tilting forward. The movable plate is slid away from the blocking wall and inclined forward in order to incorporate the main unit into the outer case, and thereafter the movable plate is raised to fit along the front face of the main unit and slid back to the position where the movable plate is supported by the blocking wall. Accordingly, the movable plate prevents the main unit from moving toward the inside of the room or being pushed out from the outside of the room.

The movable plate may have a spring force to keep itself upright at the position where it is slid and supported by the blocking wall. When the main unit is installed, the movable plate is slid away from the blocking wall and inclined forward against the spring force. After the main unit is slid into the outer case, the movable plate is raised to fit along the front face of the main unit. Then, the movable plate automatically slides back to the position where the upright movable plate is supported by the blocking wall.

Still another exemplary fastening means is a structure formed of a lock button provided at the bottom plate of the main unit, which can project upward and downward from the bottom thereof, and a depression in the outer case which can receive the lock button.

Specifically, the lock button which can project toward the outer case from the bottom plate of the main unit is provided at a position which can be handled inside the room. When the main unit is slid into the outer case, the button is kept in the non-projecting state. When the main unit has completely been slid therein, the button projects from the bottom plate to enter the depression in the outer case. In this way, the main unit and the outer case are securely coupled.

If the lock button has a spring force which constantly drives the button in the direction which causes the button to project from the bottom plate of the main unit, the button is surely maintained in the depression.

Briefly, an integral type air conditioner according to the present invention includes an outer case attached to an opening of a wall, a main unit which is slid into the outer case and installed therein, and fastening means which can be handled in the room for coupling and fastening the main unit slid in the outer case and the outer case to each other. The fastening means prevents the main unit slid in the outer case from moving toward the inside of the room.

A preferred integral type air conditioner according to the present invention has fastening means which includes a hole provided in the bottom of the outer case and a fixed member placed along the front wall of the main unit and engaged with the hole and fixed therein. Preferably, the hole is a long slit-shaped hole and the fixed member includes a bottom portion with a hook-shaped part inserted into the long hole and an upright portion placed along the front wall of the main unit. More preferably, the fastening means further includes a substantially U-shaped elastic clip for holding and securing therein the upright portion of the fixed member and the front wall of the main unit. Alternatively, the fastening means more preferably further includes a screw member for fastening the upright portion of the fixed member to the front wall of the main unit.

Another preferred integral type air conditioner according to the present invention has fastening means which includes a fixed plate attached to the bottom of the outer case and a movable plate which is movable with respect to the fixed plate and can be fixed along the front wall of the main unit. Preferably, the fastening means further includes a blocking wall member provided to the fixed plate in order to fix the movable plate along the front wall of the main unit. More preferably, the movable plate is slidable with respect to the fixed plated between the positions where the movable plate is in contact and not in contact with the blocking wall member respectively, and the movable plate is coupled to the fixed plate such that the movable plate rises along the front wall of the main unit when it is in contact with the blocking wall member and is inclined forward away from the main unit and falls toward the front of the main unit when it is not in contact with the blocking wall member. Still more preferably, the fastening means further includes an elastic member for applying a biasing force to the movable plate to keep it in contact with the blocking wall member.

Still another preferred integral type air conditioner according to the present invention has fastening means which includes a rod-shaped member provided at the bottom of the main unit such that the rod-shaped member can project upward and downward from the bottom, and a depression provided in the outer case such that the depression can receive the rodshaped member. Preferably, the fastening means further includes an elastic member for applying a biasing force to the rod-shaped member in order to keep the rod-shaped member fit in the depression of the outer case.

According to the present invention as heretofore described, instead of fixing the main unit and the outer case to each other with screws inserted from the outside of the outer case through the side faces thereof, fastening means is provided for securely coupling, at the position which can be managed inside the room, the outer case and the main unit slid therein to each other. The main unit slid into the outer case is thus prevented from being pushed out toward the inside of the room. In this way, the main unit and the outer case can be fixedly coupled to each other by an operation performed on the front side thereof in the room. Then, the operation can efficiently be done and reduction of the time required for installation is thus possible. Further, the secure coupling which is manageable inside the room can be watched easily by the operator. Therefore, it is possible to easily confirm if any operation is completed and accordingly prevent failure to perform the operation.

In a preferred embodiment, installation can be completed by the fastening means just by inserting and thereafter sliding its fixed angle in the rectangular hole of the outer case. In another preferred embodiment, the fastening means has the fixed angle which is prevented from wobbling and thus stable attachment is achieved. In still another preferred embodiment, the employed fastening means has the fixed plate which is attached to the bottom of the outer case in order to ensure attachment, and the installation can be completed by merely sliding the movable plate. In this case, if the spring force is applied to automatically slide the movable plate to the raised position where the upright movable plate is supported by the blocking wall, the outer case and the main unit are securely coupled automatically to avoid failure to operate. Further, if the fastening means with the lock button fit in the depression of the outer case is employed, the main unit and the outer case can surely be coupled fixedly. If the spring force is applied to the lock button, the button is surely kept fit in the depression and accordingly the main unit is surely fixed.

The integral type air conditioner employing the fastening means of any type according to the present invention can provide a simpler installation work and a shorter working time compared with the conventional integral type air conditioner having the main unit and the outer case fixed to each other by using screws inserted through the side surfaces from the outside of the outer case. According to the present invention, the main unit can surely be fastened in any installation conditions and can be fastened easily without a special tool. It can thus be avoided that the main unit is pushed out from the outside toward the inside of the room and a resultant opening is utilized for unlawful invasion into the room.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiments of an integral type air conditioner according to the present invention are described below together with examples of installation in conjunction with the drawings.

First Embodiment

Figure 1:
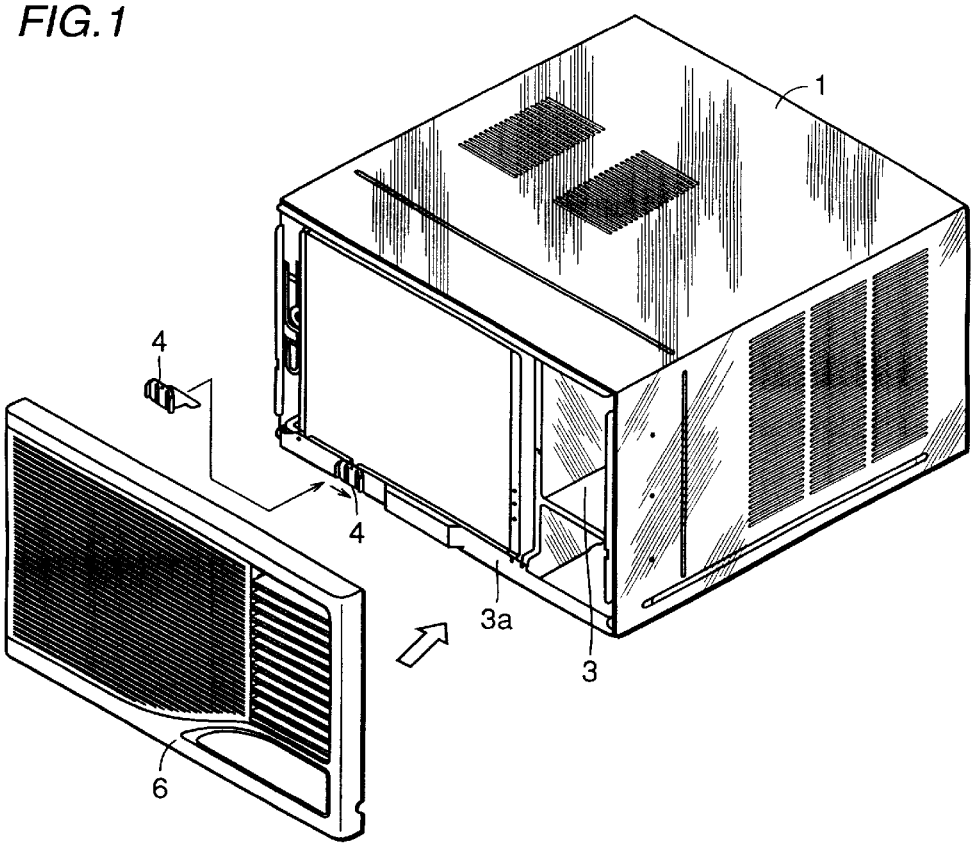
FIG. 1 is a perspective view showing an integral type air conditioner in a first embodiment according to the present invention.

FIG. 1 is a perspective view illustrating an integral type air conditioner in the first embodiment according to the present invention.

An outer case 1 is first fixed in an opening of a wall 2, and then a main unit 3 is slid into and fixed to outer case 1, similarly to the example of the conventional installation. In the first embodiment, a fixed angle 4 is used to fasten main unit 3 and outer case 1 to each other, at a position inside the room.

Figure 2:
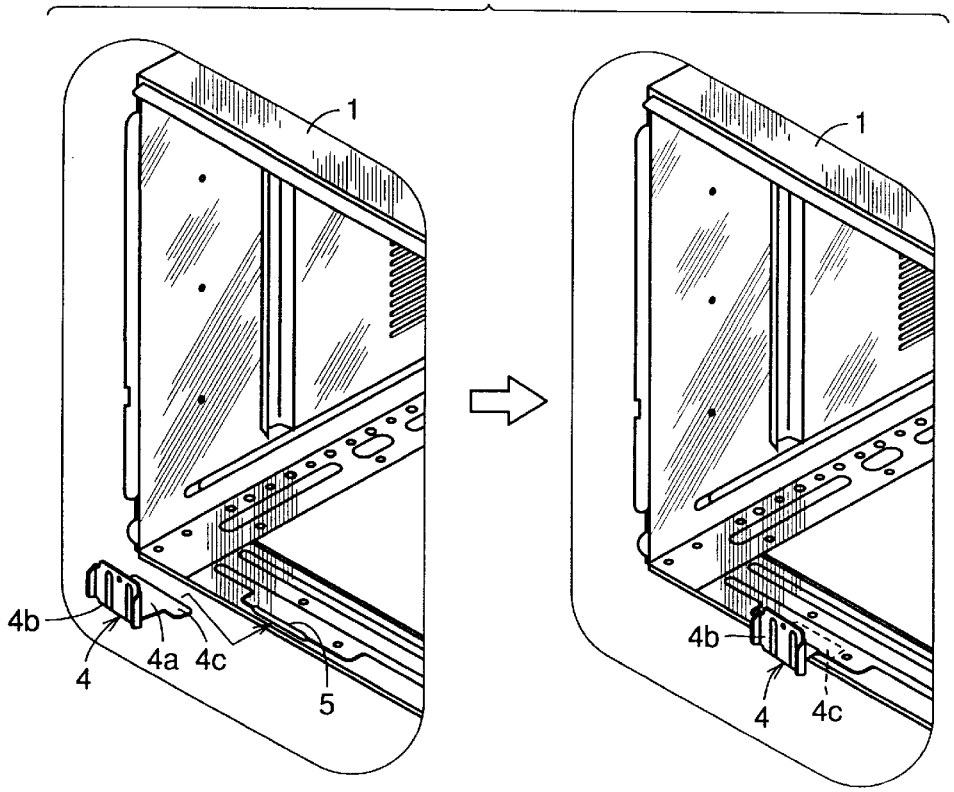
FIG. 2 illustrates installation in detail in the first embodiment.

A relation between fixed angle 4 and outer case 1 is shown in FIG. 2. It is noted that main unit 3 placed in outer case 1 is not shown in FIG. 2 for convenience of description. A long hole 5 in the shape of a rectangular slit is provided in the bottom on the front side of outer case 1. A hook-shaped bottom portion 4*a* of fixed angle 4 is inserted into long hole 5, an upright portion 4*b* of fixed angle 4 is fit along a front wall 3*a* of main unit 3, and then fixed angle 4 is slid along long hole 5 of outer case 1. This sliding operation allows an engaging end 4*c* of hook-shaped bottom portion 4*a* of fixed angle 4 to engage with outer case 1 and to be fastened thereto. Consequently, main unit 3 cannot be pushed out toward the inside from the outside of the room. A front panel 6 is thereafter fit on outer case 1 and the installation work is completed.

Second Embodiment

Figure 3:
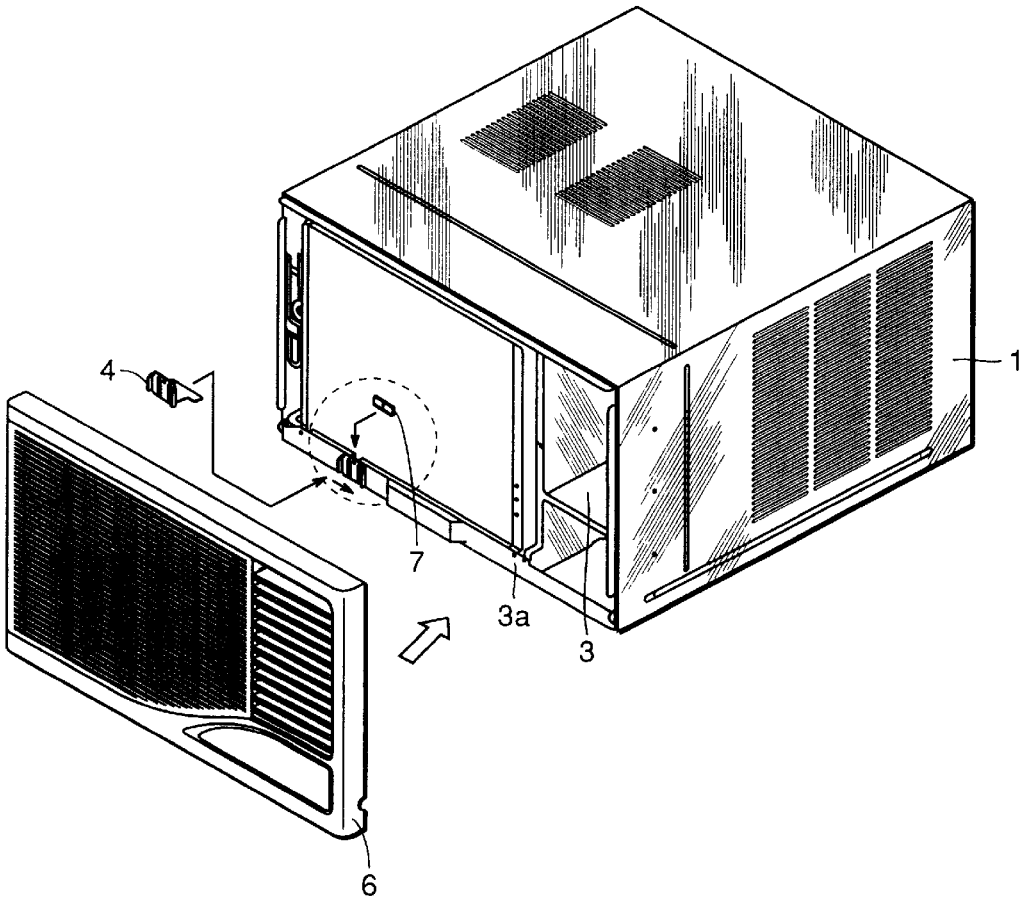
FIG. 3 is a perspective view showing an integral type air conditioner in a second embodiment.
Figure 4:
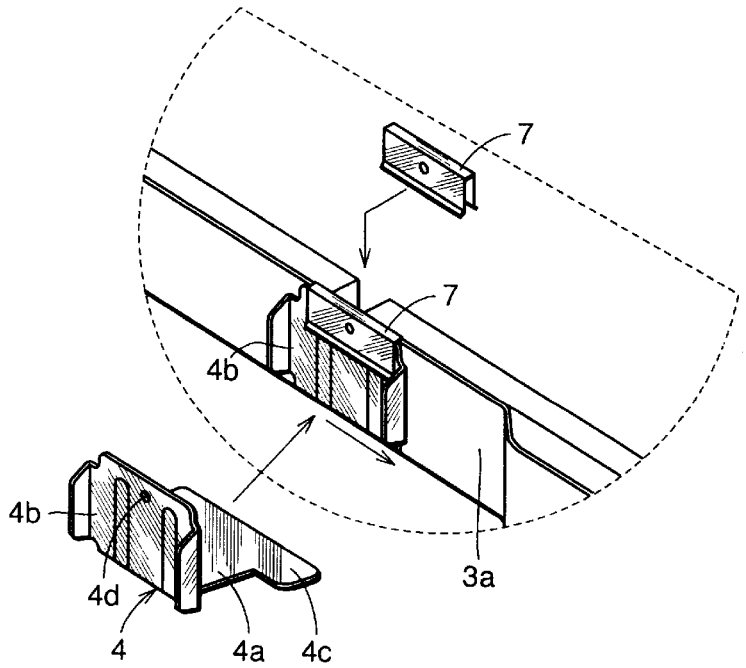
FIG. 4 illustrates installation in detail in the second embodiment.

The second embodiment is described in conjunction with FIGS. 3 and 4.

In the first embodiment described above, fixed angle 4 is attached to outer case 1 to prevent main unit 3 from being pushed out toward the inside of the room. However, since fixed angle 4 and main unit 3 are not fastened to each other, fixed angle 4 could be unstable and thus wobble, resulting in separation from outer case 1. Considering this, the second embodiment is characterized by that a main unit 3 and a fixed angle 4 are held and secured in an elastic clip 7 to surely hold fixed angle 4.

Figure 5:
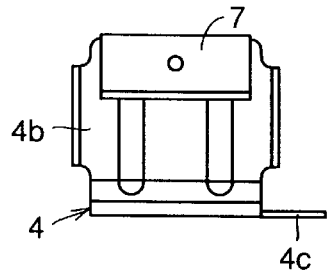
FIG. 5 is a front view showing fastening means in the installation in the second embodiment.
Figure 6:
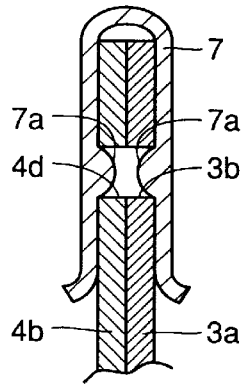
FIG. 6 is a cross section showing a main part of the installation in the second embodiment.

Elastic clip 7 is substantially in the U-shape, holds therein fixed angle 4 and a front wall 3*a* of main unit 3 therein, and is accordingly fixed. As shown in FIGS. 5 and 6, projections 7*a* are formed inside the U-shape at the central portion of the clipping part. In addition, holes 3*b* and 4*d* are provided respectively in front wall 3*a* of main unit 3 and an upright portion 4*b* of fixed angle 4 in order to receive projections 7*a* of elastic clip 7. Projections 7*a* and the clipping force of elastic clip 7 ensure fixed angle 4 to be fastened to main unit 3. After this, a front panel 6 is fit on outer case 1 and the installation work is completed.

Third Embodiment

Figure 7:
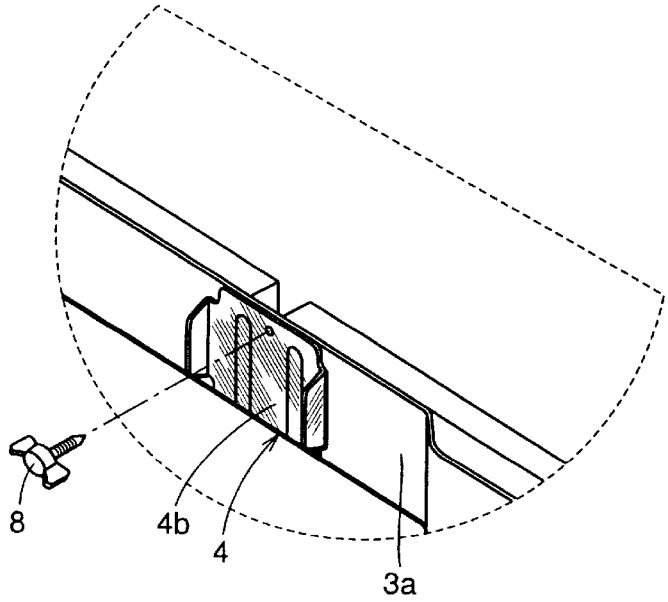
FIG. 7 is a perspective view showing an integral type air conditioner in a third embodiment.

The third embodiment is now described in conjunction with FIG. 7. The third embodiment employs a wing screw 8 instead of elastic clip 7 in the second embodiment above.

Specifically, a hole is formed in an upright portion 4*b* of a fixed angle 4 and a screw hole is formed in a front wall 3*a* of a main unit 3 so as to screw and fix wing screw 8 from the inside of the room into the holes. Fixed angle 4 is thus fastened to main unit 3 to prevent wobbling and separation of fixed angle 4. Then, a front panel 6 is fit on an outer case 1 and the installation is completed.

Fourth Embodiment

Figure 8:
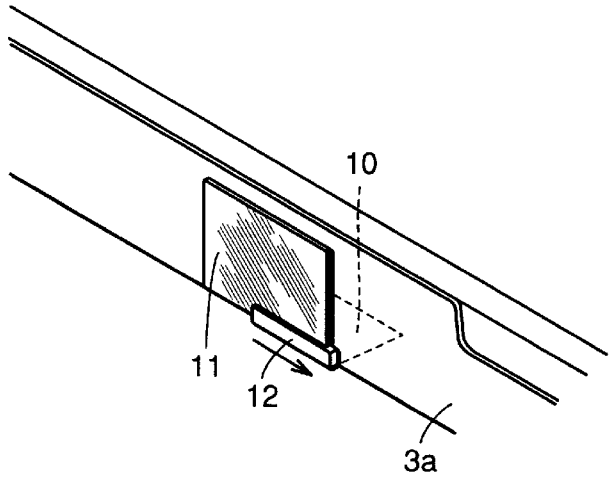
FIG. 8 is a perspective view showing a main portion of an integral type air conditioner in a fourth embodiment.

The fourth embodiment is described below in conjunction with FIGS. 8, 9 and 10.

Fastening means in this embodiment is formed of a fixed plate 10 attached to the bottom of an outer case 1 by using fixing means such as a screw, and a movable plate 11 which can rise, incline and slide with respect to fixed plate 10. Specifically, as shown in FIGS. 9 and 10, a blocking wall 12 is provided on one side of fixed plate 10 to leave a gap in which movable plate 11 can enter, and bearings 13 and 14 support a guide shaft 15. Movable plate 11 has coupling pieces 16 and 16 into which guide shaft 15 is inserted. In this way, movable plate 11 is coupled to fixed plate 10 such that the former can rise, fall and slide with respect to the latter.

Figure 9:
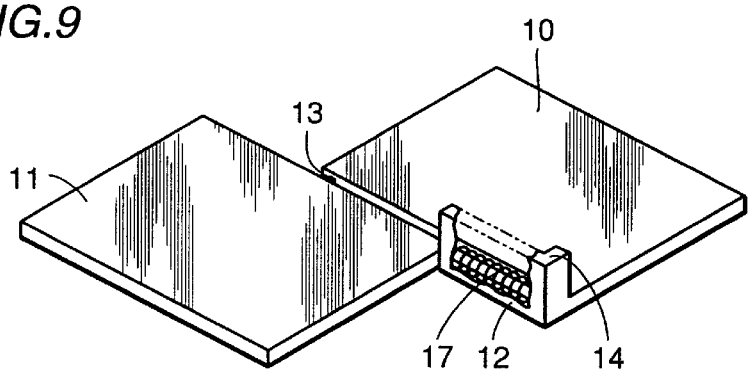
FIG. 9 is a perspective view showing fastening means employed in the fourth embodiment.
Figure 10:
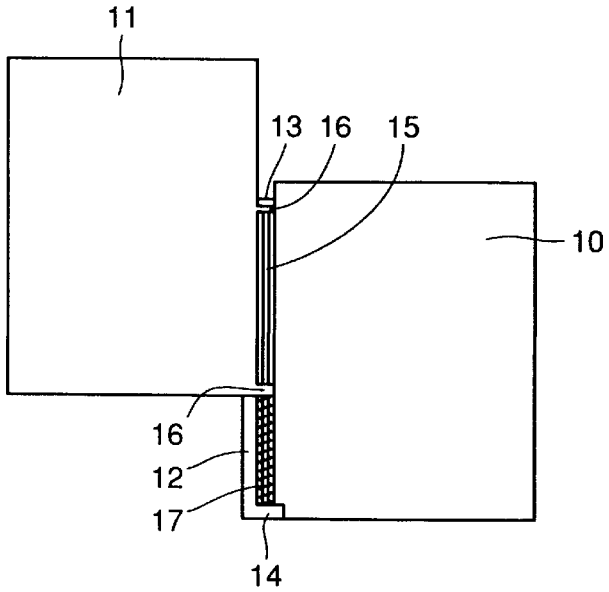
FIG. 10 is a plan view of the fastening means employed in the fourth embodiment.

Referring to FIGS. 9 and 10, movable plate 11 slid away from blocking wall 12 falls toward the front. In this state, a main unit 3 is slid into an outer case 1. After this, movable plate 11 is raised to fit along a front wall 3*a* of main unit 3 and is then slid. Blocking wall 12 accordingly prevents movable plate 11 from inclining forward as shown in FIG. 8. Therefore, main unit 3 cannot be pushed out from the outside toward the inside of the room. The installation work is thereafter completed by fitting a front panel 6 on outer case 1.

A tension coil spring 17 can be provided between one bearing 14 and coupling piece 16 as shown in order to apply a spring force which constantly draws movable plate 11 toward the rear side of blocking wall 12. As a result, it is possible to prevent movable plate 11 from wobbling and to fasten movable plate 11 in a stable manner. In addition, when movable plate 11 rises, the spring force automatically draws movable plate 11 to the rear side of blocking wall 12 and fastening of main unit 3 is accordingly completed.

In order to ensure the attachment of the fastening means with or without such a spring force applied, elastic clip 7 employed in the second embodiment or wing screw 8 employed in the third embodiment may be used as means for fixing movable plate 11 to front wall 3*a* of main unit 3.

Fifth Embodiment

Figure 11:
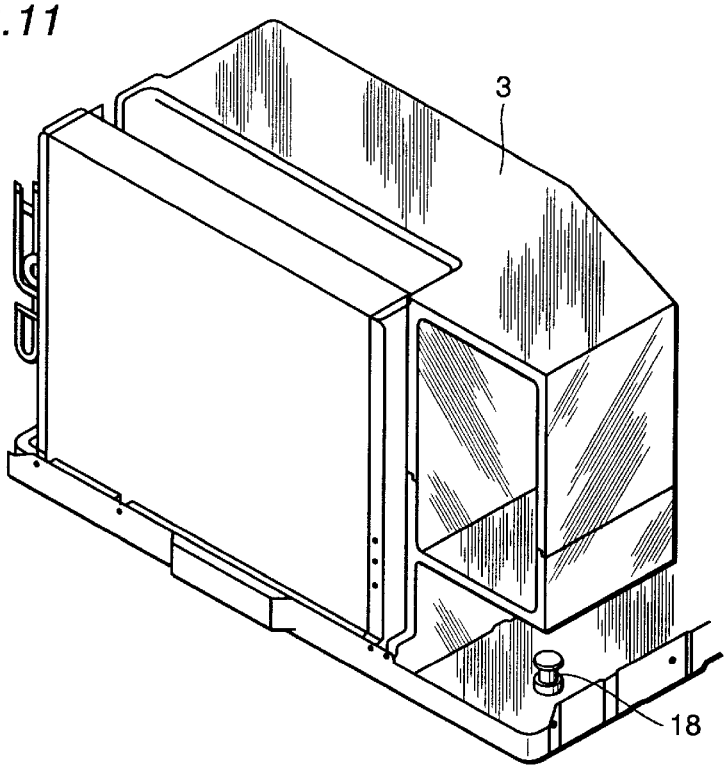
FIG. 11 is a perspective view showing a main portion of a main unit of an integral type air conditioner in a fifth embodiment.
Figure 12:
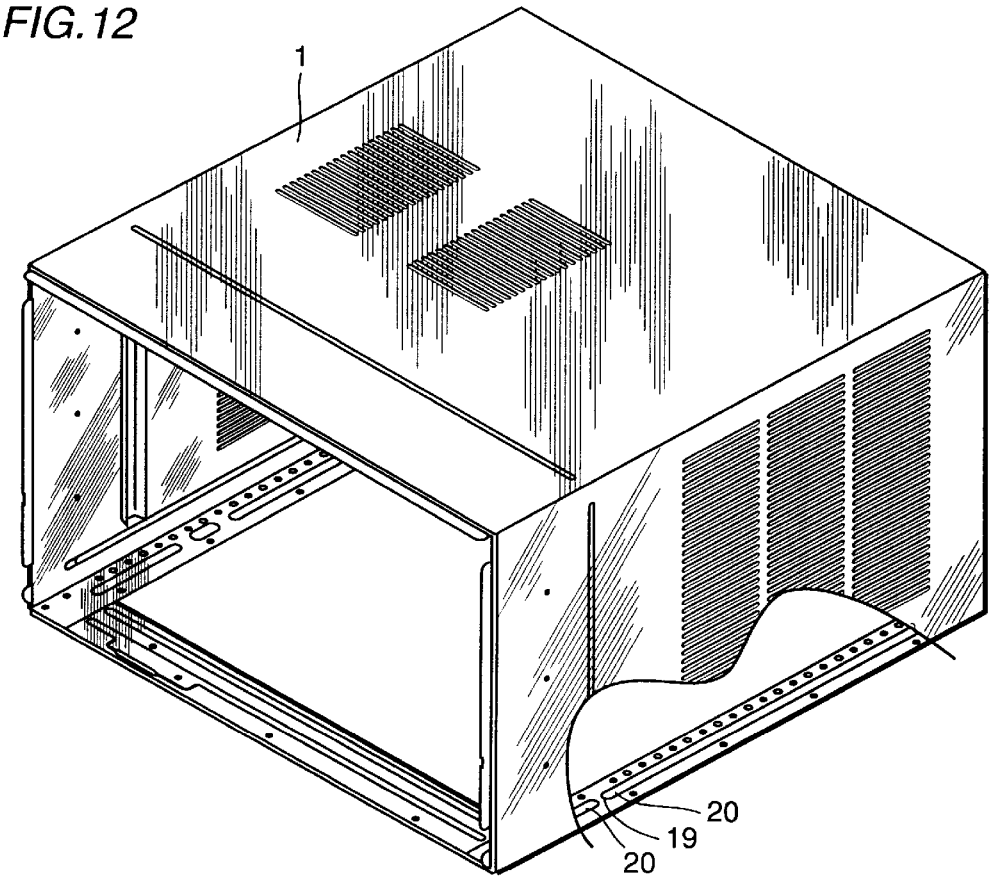
FIG. 12 is a partially broken perspective view of an outer case in the fifth embodiment.
Figure 13:
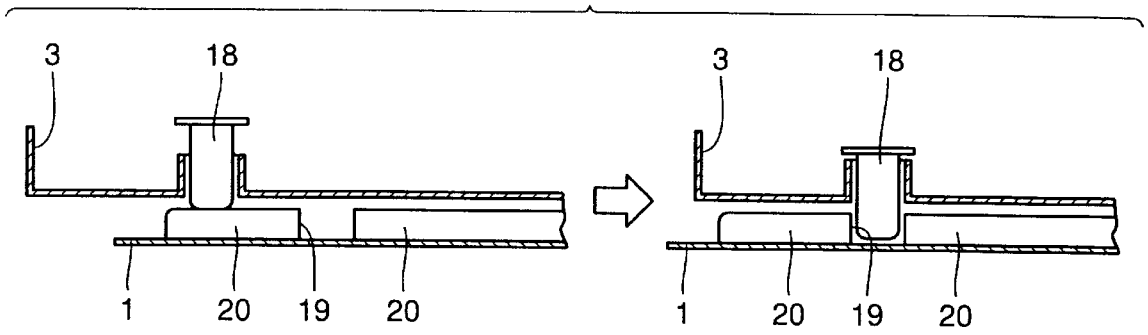
FIG. 13 is a cross section illustrating an operating state of fastening means in the fifth embodiment.
Figure 14:
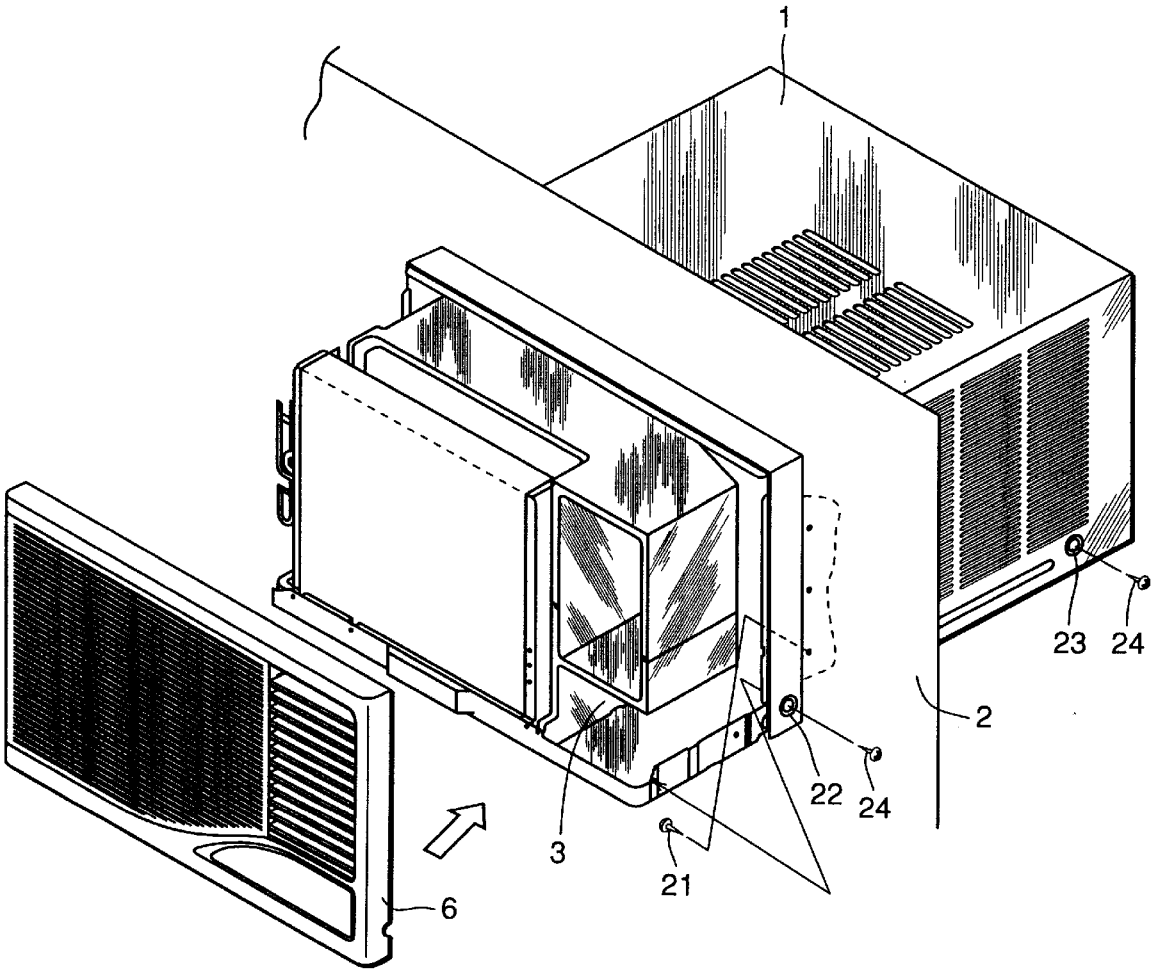
FIG. 14 PRIOR ART
FIG. 14 is a perspective view illustrating installation of a conventional integral type air conditioner.

The fifth embodiment is described in conjunction with FIGS. 11, 12 and 13.

In the fifth embodiment, fastening means is provided including a lock button 18 provided at a position which can be handled inside the room. Lock button 18 can project from the bottom of a main unit 3 toward an outer case 1 and return inversely. The fastening means further includes a depression 19 in outer case 1 in which lock button 18 can be fit. Specifically, when main unit 3 is slid into outer case 1, lock button 18 is kept in a nonprojecting state. When the sliding is completed, lock button 18 projects from the bottom of main unit 3 to enter depression 19 in outer case 1. In this way, main unit 3 is securely coupled to outer case 1 and never pushed out toward the inside of the room.

Although depression 19 formed in outer case 1 in which lock button 18 enters is shown as a gap between adjacent parts 20 produced by discontinuously performing a drawing process on the bottom of outer case 1, the depression is not limited to such a structure.

Lock button 18 can surely be kept fit in depression 19 by constantly applying a spring force to lock button 18 to project in the direction from the bottom of main unit 3, which is implemented by a leaf spring pressing the top of lock button 18.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An integral type air conditioner comprising:

an outer case attached to an opening of a wall;

a main unit slid into said outer case; and fastening means which is manageable from within a room adjacent the opening for coupling said main unit and said outer case to each other, said fastening means preventing said main unit from moving toward the inside of the room.

2. The integral type air conditioner according to claim 1, wherein said fastening means includes a hole provided in a bottom portion of said outer case and a fixed member which is placed along a front wall of said main unit and is engaged with said hole and fixed therein.

3. The integral type air conditioner according to claim 2, wherein said hole is a slit, and said fixed member includes a bottom portion having a hook-shaped part inserted into said slit and an upright portion placed along the front wall of said main unit.

4. The integral type air conditioner according to claim 3, wherein said fastening means further includes a clip for holding and securing the upright portion of said fixed member and the front wall of said main unit.

5. The integral type air conditioner according to claim 3, wherein said fastening means further includes a screw member for fastening the upright portion of said fixed member and the front wall of said main unit to each other.

6. The integral type air conditioner according to claim 1, wherein said fastening means includes a fixed plate attached to a bottom portion of said outer case and a movable plate which is movable with respect to said fixed plate to a position along the front wall of said main unit.

7. The integral type air conditioner according to claim 6, wherein said fastening means further includes a blocking wall member associated with said fixed plate for holding said movable plate in a position along the front wall of said main unit.

8. The integral type air conditioner according to claim 7, wherein said movable plate is slidable with respect to said fixed plate between a first position in contact with said blocking wall member and a second position not in contact with said blocking wall member, and said movable plate is positioned along the front wall of said main unit in said first position in contact with said blocking wall member and said movable plate is movable away from the front of said main unit in said second position not in contact with said blocking wall member.

9. The integral type air conditioner according to claim 8, wherein said fastening means further includes an elastic member for applying a biasing force to said movable plate for biasing said movable plate into said first position in contact with said blocking wall member.

10. The integral type air conditioner according to claim 1, wherein said fastening means includes a member which is provided at a bottom surface of said main unit and which can project from the bottom surface of said main unit, and a depression provided in said outer case for receiving said rod-shaped member.

11. The integral type air conditioner according to claim 10, wherein said fastening means further includes an elastic member for applying a biasing force to said member for biasing said member into said depression of said outer case.

* * * * *

UNITED STATES PATENT AND TRADEMARK OFFICE

CERTIFICATE OF CORRECTION

PATENT NO. : 6,289,687 B1
DATED : September 18, 2001
INVENTOR(S) : Yuki Kawano et al.

It is certified that error appears in the above-identified patent and that said Letters Patent is hereby corrected as shown below:

Title page,
Item [57], ABSTRACT,
Line 7, change "is never" to -- cannot be --.
Line 8, change "outside" to -- outer case --; and change "main unit" to -- room --.

Column 1,
Line 36, change "unavailable" to -- inaccessible --.
Line 49, change "unfixed" to -- not completely fixed --.
Line 50, change "screwing" to -- inserting all screws --.
Line 51, change "screwing" to -- inserting some or all of the screws --.
Line 55, change "could" to -- might --.
Line 57, change "screwing" to -- inserting all screws --.

Column 2,
Line 40, delete "inversely" and after "sliding" insert -- in an opposite direction --.
Line 59, after "plated" insert -- which is --.
Line 62, change "to" to -- on --.
Line 65, change "incorporate" to -- insert --.

Column 3,
Line 5, change "itself" to -- it --.
Line 16, after "can" insert -- slide or --.
Line 30, delete "surely" and after "maintained" insert -- securely --.
Line 36, change "in" to -- from within --.
Line 61, change "to" (first occurrence) to -- on --.
Line 64, delete "the" (first occurrence).

Column 4,
Line 2, after "forward" insert -- and --.
Line 12, before "project" insert -- slide or --.
Line 22, change ", at the" to -- the outer case and the main unit to each other at a --.
Line 23, after "managed" insert -- from -- and after "room" delete ", the outer case and the main unit slid therein to each other".

UNITED STATES PATENT AND TRADEMARK OFFICE

CERTIFICATE OF CORRECTION

PATENT NO. : 6,289,687 B1
DATED : September 18, 2001
INVENTOR(S) : Yuki Kawano et al.

It is certified that error appears in the above-identified patent and that said Letters Patent is hereby corrected as shown below:

Column 4,
Line 32, change "watched" to -- observed --.
Line 33, change "if any" to -- that the --.
Line 34, change "to perform" to -- of --.
Line 37, change "its" to -- a -- and change "in the" to -- into a --.
Line 40, after "thus" insert -- more --.
Line 41, delete "employed".
Line 41, change "has the" to -- comprises a --.
Line 45, change "the" (first occurrence) to -- a--.
Line 48, delete "to".
Line 49, delete "avoid failure to operate".
Line 49, after "Further," delete "if"; after "means" delete "with".
Line 50, delete "the" before "lock".
Line 50, change "the" (first occurrence) to -- may include a --.
Line 50, change "the" (second occurrence) to -- a -- and delete "is".
Line 51, delete "employed, the main unit and the outer case can surely be".
Line 52, delete "coupled fixedly" and change "If the" to -- A --.
Line 52, change "is" to -- may be --.
Line 53, change ", the button is surely kept fit" to -- to hold the button --.
Line 54, change "surely" to -- securely --.
Line 56, change "type" to -- embodiment --.
Line 57, change "work and" to -- in --.

Column 5,
Line 56, change "other," to -- other; Angle 4 is located --.
Line 56, after "position" insert -- that is accessible --.
Line 60, change "A long" to -- An elongated --.
Line 64, change "5, an" to -- 5; An --.
Line 64, change "is fit" to -- thus extends --.
Line 65, change ", and then fixed" to -- 3; Fixed --.
Line 65, delete ", and then fixed" and insert -- 3; Fixed --.

UNITED STATES PATENT AND TRADEMARK OFFICE

CERTIFICATE OF CORRECTION

PATENT NO. : 6,289,687 B1
DATED : September 18, 2001
INVENTOR(S) : Yuki Kawano et al.

It is certified that error appears in the above-identified patent and that said Letters Patent is hereby corrected as shown below:

Column 6,
Line 15, change "by" to -- in --.
Line 16, change "in" to -- by --.
Line 17, change "surely" to -- securely --.
Line 18, change "in the" to -- of a --.
Line 18, after "U-shape," delete "holds", after "therein" add -- and --.
Line 19, change "3 therein, and" to -- 3. Angle 4 --.
Line 26, change "fixed" to -- that --.
Line 26, change "to be fastened" to -- is secured with respect --.
Line 35, change "so as to screw and fix" to -- A --.
Line 35, after "8" insert -- can be inserted --.
Line 48, change "in" to -- into --.
Line 51, delete "and 16".
Line 54, after "11" insert -- is --.
Line 56, after "12" insert -- and --.
Line 57, after "3" insert -- . Movable plate 11 --.
Line 58, delete "and" and after "slid" insert -- into position behind blocking wall 12 --.

Column 7,
Line 1, change "wobbling" to -- sliding out -- and after "and" insert -- thus --.
Line 7, after "applied," insert -- an --.
Line 7, after "applied" insert -- an -- and after "7" insert -- as --.
Line 8, after "or" insert -- a --, and after "8" insert -- as --.
Line 16, after "handled" insert -- from --.
Line 16, after "project" insert -- or slide --.
Line 25, change "never" to -- cannot be --.
Line 31, delete "surely" and change "kept fit" to -- held securely --.
Line 33, change "3," to -- 3. --.
Line 34, change "which is" to -- This may be --.

UNITED STATES PATENT AND TRADEMARK OFFICE

CERTIFICATE OF CORRECTION

PATENT NO. : 6,289,687 B1
DATED : September 18, 2001
INVENTOR(S) : Yuki Kawano et al.

It is certified that error appears in the above-identified patent and that said Letters Patent is hereby corrected as shown below:

Column 8,
Line 7, after "a" insert -- substantially U-shaped elastic --.
Line 47, before "member" insert -- rod-shaped --.
Line 55, after "said" insert -- rod-shaped --.
Line 56, after "said" insert -- rod-shaped --.

Signed and Sealed this

Eighth Day of October, 2002

*Attest:*

*Attesting Officer*

JAMES E. ROGAN
*Director of the United States Patent and Trademark Office*